US008702376B2

(12) United States Patent
Mokulys et al.

(10) Patent No.: US 8,702,376 B2
(45) Date of Patent: Apr. 22, 2014

(54) HIGH TEMPERATURE RADIALLY FED AXIAL STEAM TURBINE

(75) Inventors: Thomas Mokulys, Wuerenlingen (CH); Vishal Borikar, Nussbaumen (CH); Giorgio Zanazzi, Baden (CH); Davor Kriz, Baden (CH); Ludwig Boxheimer, Rieden (CH); Luca Ripamonti, Rieden (CH)

(73) Assignee: Alstom Technology Ltd., Baden (CH)

( * ) Notice: Subject to any disclaimer, the term of this patent is extended or adjusted under 35 U.S.C. 154(b) by 655 days.

(21) Appl. No.: 12/902,588

(22) Filed: Oct. 12, 2010

(65) Prior Publication Data

US 2011/0085887 A1 Apr. 14, 2011

(30) Foreign Application Priority Data

Oct. 12, 2009 (IT) ..... MI2009A1740

(51) Int. Cl.
*F01D 1/00* (2006.01)

(52) U.S. Cl.
USPC ..... 415/117; 415/914; 416/95

(58) Field of Classification Search
USPC ..... 415/116, 117, 14, 56.1, 56.4, 56.5, 415/58.2, 58.5, 58.7, 59.1; 416/95
See application file for complete search history.

(56) References Cited

U.S. PATENT DOCUMENTS

| | | | | |
|---|---|---|---|---|
| 5,215,436 | A | 6/1993 | Puzyrewski | |
| 7,264,438 | B2 * | 9/2007 | Diesler et al. | 415/1 |
| 2004/0175264 | A1 | 9/2004 | Diesler et al. | |
| 2004/0253102 | A1 | 12/2004 | Imano et al. | |
| 2007/0207032 | A1 | 9/2007 | Greim et al. | |
| 2010/0178153 | A1 | 7/2010 | Gehringer et al. | |

FOREIGN PATENT DOCUMENTS

| | | | | |
|---|---|---|---|---|
| DE | 3242713 | A1 * | 6/1983 | F01D 9/06 |
| EP | 1 455 066 | A1 | 9/2004 | |
| EP | 2 031 183 | A1 | 3/2009 | |
| FR | 1 044 197 | A | 11/1953 | |
| FR | 1 194 802 | A | 11/1959 | |
| FR | 2 351 249 | A1 | 12/1977 | |
| GB | 16249 | | 0/1909 | |
| GB | 190916249 | | 0/1909 | |
| WO | WO 2008/148607 | A1 | 12/2008 | |

OTHER PUBLICATIONS

Search Report dated Nov. 14, 2011, issued in the corresponding German Patent Application No. 10 2010 047 375.8. (6 pages).
Italian Search Report issued on Jun. 10, 2010 in corresponding Italian Application No. MI20091740.
Written Opinion dated Oct. 12, 2009 in corresponding Italian Application No. MI20091740.

* cited by examiner

*Primary Examiner* — Edward Look
*Assistant Examiner* — William Grigos
(74) *Attorney, Agent, or Firm* — Buchanan Ingersoll & Rooney PC

(57) ABSTRACT

The disclosure relates to a radially fed axial steam turbine with a cold inlet duct, axially displaced from a hot inlet duct such that is it further away from a first blade row than the hot inlet duct. The cold inlet duct receives a cold steam from a cold inlet spiral and directs it into the hot inlet duct in such a way that a boundary layer of cold steam is formed over the rotor circumferential surface between the outlet end of the cold inlet duct and the blade and vane rows. The rotor circumferential surface is also adapted to promote and maintain the boundary layer. In this way, a maximum temperature to which the rotor is exposed can be reduced.

20 Claims, 2 Drawing Sheets

HIGH TEMPERATURE RADIALLY FED AXIAL STEAM TURBINE

RELATED APPLICATION(S)

This application claims priority under 35 U.S.C. §119 to Italian Patent Application No. M12009A001740 in Italy on Oct. 12, 2009, the entire content of which is hereby incorporated by reference in its entirety.

FIELD

The disclosure generally relates to high temperature radially fed axial steam turbines, including heat stress of the rotor by high temperature steam.

Throughout this specification "high temperature" in relation to steam and steam turbines is defined as a temperature of 650° C. or greater.

BACKGROUND INFORMATION

On account of a continuing effort towards improving efficiency of steam turbine installations, it can be desirable to operate turbines at high temperatures. However known materials can exhibit poor performance above 650° C. and most particularly above 700° C. For this reason, turbine parts such as rotors, casings and blades can be made of more expensive exotic alloys. An example of one such alloy is described in U.S. Patent Application 2004/0253102 A1. While for cost reasons it may be beneficial to manufacture any component, as least partly, from known materials, it can be particularly desireable to do so for large components, like rotors, and for complex components, like blades.

A solution is to minimize exposure of component parts to high temperature. U.S. Patent Application US2007/0207032 A1, for example, describes one arrangement that provides a large temperature drop across the first stage and so only the first stage and any rotor components upstream of this stage are exposed to high temperature.

Another solution is to provide cooling medium to high temperature regions. It can however be technically difficult to provide enough cooling to large turbine components such as the rotor.

SUMMARY

A high temperature radially fed axial steam turbine is disclosed comprising: a rotatable rotor with a rotational axis and a circumferential surface; a casing enclosing the rotor so as to form an annular space between the rotor and the casing; axially distributed blade and vane rows mounted in the annular space on the rotor; a hot inlet duct for steam, that circumferentially extends around the rotor axis and has: a radial inlet end circumscribing the rotor; and an axial outlet end circumscribing the rotor and axially joined to the annular space immediately upstream of the blade and vane rows; a cold inlet spiral for receiving a cold steam, circumferentially extending around the rotor axis that is configured to circumferentially distribute the cold steam; and a cold inlet duct for a cold steam, connected at an inlet end to a downstream end of the cold inlet spiral and axially displaced from the hot inlet duct such that the hot inlet duct is between the cold inlet duct and blade and vane rows, the cold inlet duct having an outlet end, in the hot inlet duct, that circumscribes the rotor and is configured to provide a boundary layer of cold steam over the circumferential surface between the outlet end of the cold inlet duct and the blade and vane rows, wherein the rotor circumferential surface between the cold inlet duct outlet end and the blade and vane rows is configured to promote and maintain the boundary layer.

A method for operating a high temperature radially fed axial steam turbine is disclosed having a rotatable rotor with a rotational axis and a circumferential surface; a casing enclosing the rotor so as to form an annular space between the rotor and the casing; axially distributed blade and vane rows mounted in the annular space on the rotor; a hot inlet duct for steam, that circumferentially extends around the rotor axis and has: a radial inlet end circumscribing the rotor; and an axial outlet end circumscribing the rotor and axially joined to the annular space immediately upstream of the blade and vane rows, the method comprising: receiving a cold steam via a cold inlet spiral circumferentially extending around the rotor axis to circumferentially distribute the cold steam, a cold inlet duct for the cold steam being connected at an inlet end to a downstream end of the cold inlet spiral and being axially displaced from the hot inlet duct such that the hot inlet duct is between the cold inlet duct and blade and vane rows, the cold inlet duct having an outlet end, in the hot inlet duct, that circumscribes the rotor and is configured to provide a boundary layer of cold steam over the circumferential surface between the outlet end of the cold inlet duct and the blade and vane rows, wherein the rotor circumferential surface between the cold inlet duct outlet end and the blade and vane rows is configured to promote and maintain the boundary layer; and simultaneously injecting the cold steam through the hot inlet duct and a hot steam through the hot inlet duct, wherein a temperature of the cold steam is less than a temperature of the hot steam.

BRIEF DESCRIPTION OF THE DRAWINGS

By way of example, an embodiment of the present disclosure is described more fully hereinafter with reference to the accompanying drawings, in which.

Figure 1:
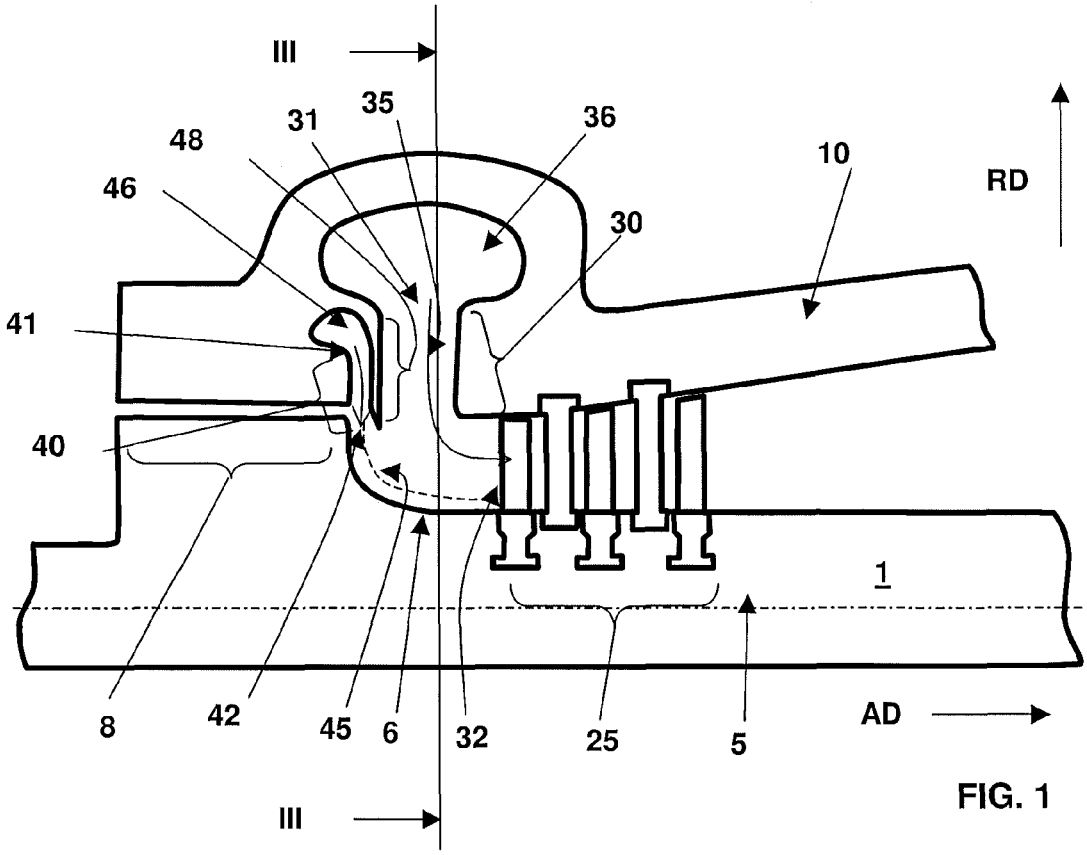
FIG. 1 is a sectional view of a radially fed axial steam turbine according to an exemplary embodiment.

Exemplary embodiments of the present disclosure are described with reference to the drawings, wherein like reference numerals are used to refer to like elements throughout. In the following description, for purposes of explanation, numerous specific details are set forth in order to provide a thorough understanding of the disclosure. It may be evident, however, that the disclosure may be practiced without these specific details.

Other aspects and advantages of the present disclosure will thus become apparent from the following description, taken in connection with the accompanying drawings wherein by way of illustration, exemplary embodiments of the disclosure are disclosed.

DETAILED DESCRIPTION

Provided is a high temperature radial fed axial steam turbine with features that in an aspect are directed towards addressing heat stress of a rotor of a steam turbine in a region before fed stream passes through the first blade row and heat energy is removed.

As described herein, exemplary embodiments can provide a high temperature radially fed axial steam turbine comprising a rotor, a casing, axially displaced blade and vane rows and a hot inlet duct. The rotor can be rotatable and have a surface extending in an axial direction. The casing encloses the rotor to form an annular space between the rotor and the casing in which the blade and vane rows are mounted. The hot inlet duct, for receiving a hot steam, axially extends over a portion of the rotor to an outlet end upstream and immediate adjacent the blade and vanes rows. The hot inlet duct can direct a hot steam to the blade and vanes rows. The steam turbine can further include a cold inlet duct connected to a downstream end of a cold inlet spiral and axially displaced from the hot inlet duct such that the hot inlet duct is located axially closer to the first blade than the cold inlet duct. The cold inlet spiral can be configured (i.e., adapted) to receive a cold steam that is colder than the hot steam. The cold inlet duct can have an inlet end and an outlet end formed between the rotor and the hot inlet duct outlet end. In the region of the outlet end, the cold inlet duct can be parallel to the rotor circumferential surface. In this way cold steam can pass over a portion of the rotor circumferential surface while passing through the hot inlet duct from the outlet end of the cold inlet duct to the blade and vane rows.

The provision of the cold steam over the portion of the rotor circumferential surface in the hot inlet duct can ensure that the rotor is not exposed to hot steam temperature, thus enabling the rotor to be made of material with lower heat strength.

In a further aspect the cold inlet duct is parallel to, in the radial direction, the hot inlet duct to provide a compact design.

In a yet further aspect, the steam turbine can include a hot inlet spiral that circumferentially extends around the rotor axis. This hot inlet spiral can be connected to the inlet end of the hot inlet duct.

In a yet further aspect, the steam turbine can further include a hot inlet pipe and a cold inlet pipe. The hot inlet pipe can be connected to the hot inlet spiral thus enabling flow of the hot steam sequentially through the hot inlet pipe, the hot inlet spiral and hot inlet duct therethrough to the interspersed blades and vanes. Meanwhile, the cold inlet pipe can be connected to the cold inlet spiral thus enabling flow of the cold steam sequentially through the cold inlet pipe, the cold inlet spiral and cold inlet duct therethrough to the hot inlet duct. In one arrangement the cold inlet pipe is parallel to the hot inlet pipe while in another arrangement the cold inlet pipe is angled at least 90° from the hot inlet pipe in the radial direction. In further exemplary arrangements, it is arranged at any suitable angle that provides a compact design. These arrangements can provide advantages in terms of axial steam turbine length and/or valve layout respectively.

In a yet further aspect the steam turbine includes a plurality of hot inlet pipes and a plurality of cold inlet pipes.

In this specification, the designations hot and cold provide a relative reference without implying any particular temperature or characteristic in the absence of a specific provision. Therefore, without such a provision a hot steam 35, for example, is a steam with a higher temperature than a cold steam 45. In relation to steam, this relative difference therefore also provides that a cold steam 45, when introduced to a region that otherwise may be exposed to hot steam 35, with the function of a cooling medium.

Figure 2:
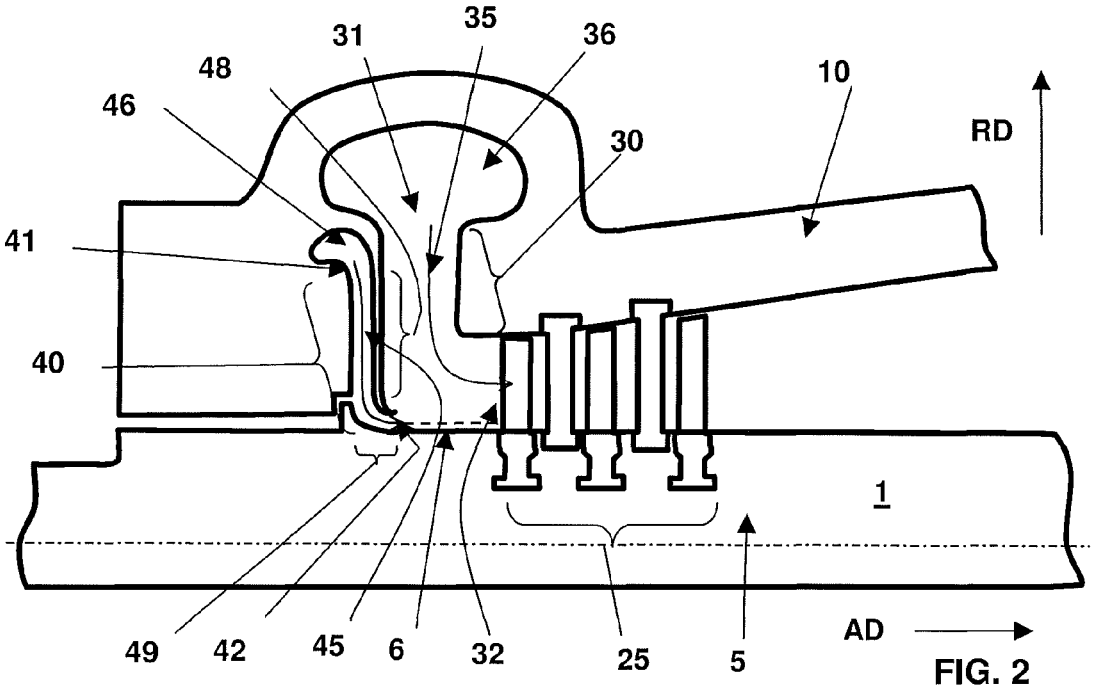
FIG. 2 is a sectional view of a radially fed axial steam turbine according to another exemplary embodiment.

FIGS. 1 and 2 show an exemplary radially fed axial steam turbine 1. The turbine 1 has a rotor 5 with a rotational axis extending in the axially direction AD. Enclosing the rotor 5 is a casing 10 that is configured to provide an enclosure in which an axial series of interspersed blade and vane rows 25 are located. The turbine further has a hot inlet spiral 36 that circumferentially extends around the rotor axis and is connected to a hot inlet duct 30 which directs hot steam 35 to the blade and vane rows 25.

The hot inlet spiral 36 can circumferentially can distribute hot steam 35 to a radial inlet 31 of the hot inlet duct 30 at a downstream end of the hot inlet spiral 36. The hot inlet duct 30 also circumscribes the rotor 5 and can ensure an even circumferential distribution of the hot steam 35. After radially entering the hot inlet duct 30 the hot steam 35 is re-directed by the hot inlet duct 30 to an axial outlet end 32 that ends immediately upstream and adjacent the blade and vane rows 25 such that the hot steam 35 from the hot inlet duct 30 flows directly into the blade and vane rows 25.

The exemplary embodiments of FIGS. 1 and 2 further show a cold inlet spiral 46 for a cold steam 45. The cold inlet spiral 46 also circumferentially extends around the rotor axis and is concentric with but axially displaced upstream of the hot inlet spiral 36. The downstream end of the cold inlet spiral 46 is connected to an inlet end 41 of a cold inlet duct 40 that is configured to direct the cold steam 45 from the cold inlet spiral 46 through an outlet end 42 into the hot inlet duct 30. In an exemplary embodiment, the inlet end 41 is a radial inlet end 41. By circumscribing the rotor 5 the cold inlet duct 40 is configured to circumferentially provide cold steam 45 into the hot inlet duct 30. Like the cold inlet spiral 46, the cold inlet duct 40 is axially displaced upstream of the hot inlet duct 30. As shown in FIG. 1, in an exemplary embodiment, this results in the hot inlet duct 30 being located closer to the blade and vane rows 25 than the cold inlet duct 40. In another exemplary embodiment the cold inlet duct 40 is further located between a piston region 8 of the rotor 5 and the hot inlet duct 30, as also shown in FIG. 1.

The relative location of the hot inlet spiral 36 and duct 30 to the cold inlet spiral 46 and duct 40 can ensure, in the exemplary embodiments shown in FIGS. 1 and 2, that the length of the steam turbine 1 is minimized. Further, a cold inlet spiral 46 can provide an even circumferential distribution cold steam 45 for optimal usage of cold steam 45.

The inlet spirals 36 and 46, as shown in FIGS. 1 and 2, are steam turbine inlet spirals that are configured using known methods to evenly distribute flow circumferentially around the rotor axis from discrete inlets. This is achieved by the cross sectional area of the spiral decreasing, as shown FIGS. 3 and 4, in the flow direction as they extend away from each discrete inlet that they may have.

An exemplary purpose of the cold inlet duct 40 is to provide a boundary layer of cold steam 45 over the rotor circumferential surface 6 between the exit of the cold inlet duct 40 and the blade and vane rows 25. This can ensure that the rotor section in this region is not exposed to hot steam 35 and as a result can be made of a material with lower hot strength.

In order to provide an adequate boundary layer, enough cold steam 45 should be provided across the rotor circumferential surface 6. This involves the correct sizing of the cold inlet duct 40. If it is too small, the cold stream 45 flow rate will be insufficient to provide a desired boundary layer. If the cold inlet duct 40 is sized too big, turbine efficiency can be adversely affected. In one exemplary embodiment the cold inlet duct 40 is sized, using known design techniques, to provide between 5-12% of the total turbine feed through the cold inlet duct 40. Depending on turbine configuration and size other flow ratios may provide an optimum. In each case however, in order to achieve a minimum specified cooling steam 45 flow rate and ensure the desired flow distribution, the cooling steam 45 should be fed from an inlet spiral.

Another exemplary factor is the shape of the outlet end 42 of the cold inlet duct 40. In addition to circumscribing the rotor 5 in order to provide cold steam 45 around the full circumference of the rotor 5, the outlet end 42 can be shaped to ensure that cold steam 45 forms a boundary layer over the rotor 5. This can be achieved by numerous known configurations of which one such arrangement is shown in FIG. 1.

FIG. 1 shows a cold inlet duct 40 that is configured to provide a boundary layer of cold steam 45 across the rotor's circumferential surface 6 through configuration and arrangement of the outlet end 42 of the cold inlet duct 40. That is to configure the outlet end 42 to have walls that are straight sided and, in another exemplary embodiment, essentially parallel to the rotor circumferential surface 6 while being free from projections such as seal elements. The rotor circumferential surface 6, in an exemplary embodiment, is adapted to maintain the boundary layer by for example comprising a smooth surface free of edges. Smooth in this context is not absolute but rather is to be taken to mean a surface free of gross surface distortions. Smooth surfaces, as shown in FIG. 1, may also include smooth curves configured, using known methods, to minimize turbulence and boundary layer separation. Other configurations are also possible. For example, in the field of aerodynamics numerous other surface arrangements, including those with roughened surfaces and edges are known to promote and maintain boundary layer formation. Any of these known configurations could also be applied to exemplary embodiments as long as they meet the criteria of promoting and maintaining a boundary layer of cold steam 45 over the rotor circumferential surface 6 between the exit of the cold inlet duct 40 and the blade and vane rows 25.

As shown in FIGS. 1 and 2, the outlet end 42 of the cold inlet duct 40 may be located in different axial and radial orientations. In an exemplary embodiment shown in FIG. 1, the cold inlet duct 40 is configured to direct flow only in the radial direction and end with a radial facing outlet end 42. This arrangement is of a known steam turbine with a piston region 8, and enables casting of the cold inlet duct 40 section in a single piece. That is the end of outlet end 42 of the cold inlet duct 40 does not extend over the piston region 8.

In an exemplary embodiment shown in FIG. 2, the cold inlet duct 40 is configured to change cold steam 45 flow direction from the radial direction to the axial direction. In this way the cold inlet duct 40 is configured with a radial section 48 and an axial section 49. So as not to adversely affect the formation of the boundary layer over the rotor circumferential surface 6 the cold inlet duct 40 can be provided with smooth transitional curves.

The exemplary embodiments shown in FIGS. 1 and 2 can be suitably used with hot steam 35 that has a temperature of over 650° C. for example 700° C. and cold steam 45 with a temperature of less than 650° C., typically 600° C. The temperature of the cold steam 45 can, for example, be selected to enable the use of less exotic alloys in the rotor 5 so as to provide a cost advantage.

Figure 3:
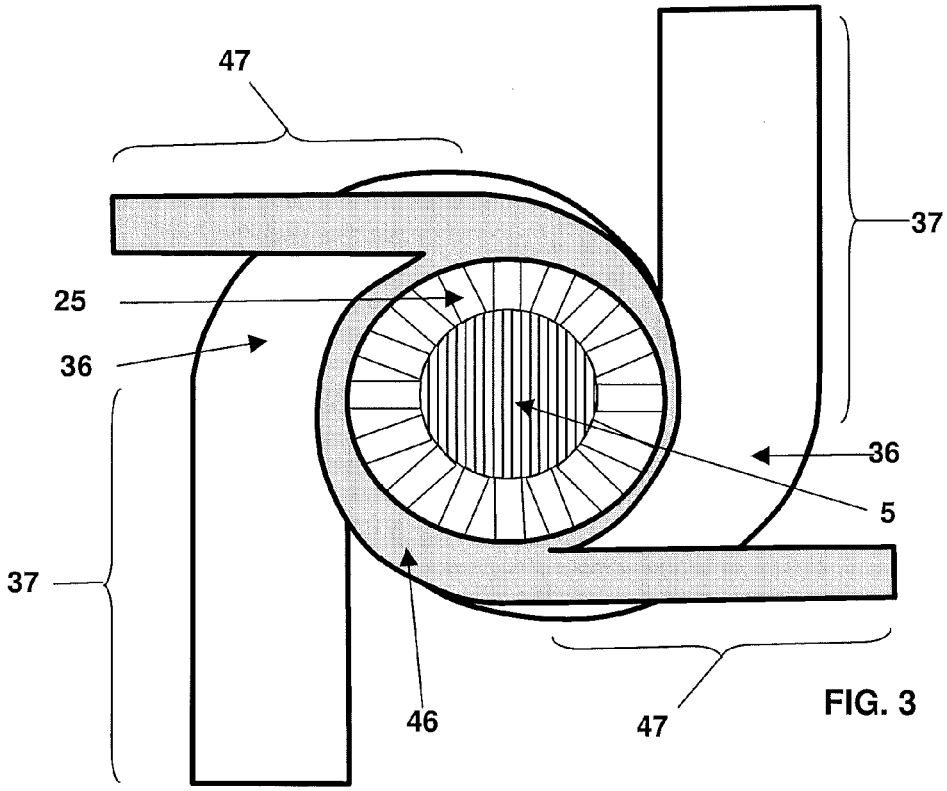
FIG. 3 is a sectional view through of FIG. 1 showing an exemplary arrangement of inlets pipes.
Figure 4:
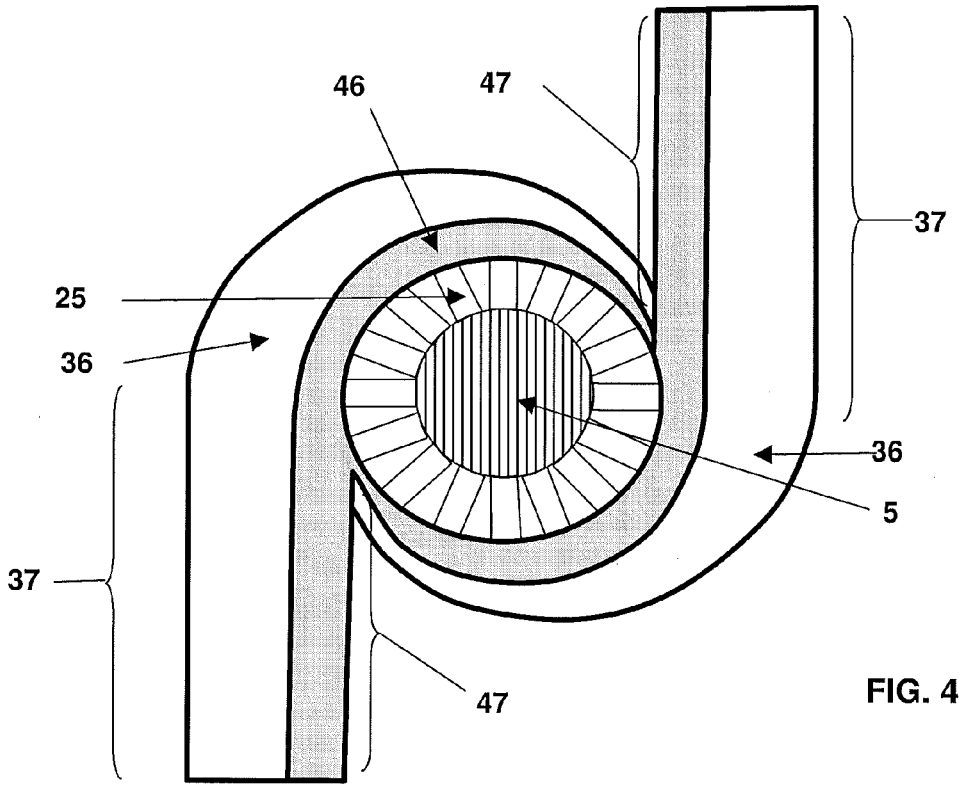
FIG. 4 is a sectional view through of FIG. 1 showing another exemplary arrangement of inlet pipes.

As shown in FIGS. 3 and 4, in exemplary embodiments, a hot inlet pipe 37 is connected to the hot inlet spiral 36. In this way, hot steam 35 can sequentially flow through the hot inlet pipe 37, the hot inlet spiral 36 and hot inlet duct 30 therethrough to the blade and vane rows 25. In a similar arrangement a cold inlet pipe 47 is connected to the cold inlet spiral 46 thus enabling a cold steam 45 to sequentially flow through the cold inlet pipe 47, the cold inlet spiral 46 and cold inlet duct 40 therethrough to the hot inlet duct 30.

In the exemplary embodiments shown in FIGS. 3 and 4, a plurality of cold and a plurality of hot inlet pipes are shown. They may be arranged such that the cold inlet pipe 47 and hot inlet pipes 37 are parallel, as shown in FIG. 4 to provide an arrangement that involves a minimum of axial turbine length.

In an alternate exemplary embodiment, shown in FIG. 3, the plurality of cold inlet pipes 47 are arranged at an angle in the radial direction of about 90° to the plurality of hot inlet pipes 37. In another exemplary embodiment comprising only one hot inlet pipe 37 and one cold inlet pipe 47, the inlet pipes 37,47 can be angled in the radial direction at least about 90° from each other. These arrangements provide additional space for inlet pipe valving equipment that can be fitted outside of the steam turbine casing 10 in known fashion.

Although the disclosure has been herein shown and described in what is considered to be the most practical exemplary embodiments, it will be appreciated by those skilled in the art that the present disclosure can be embodied in other specific forms. For example while exemplary embodiment of a single flow steam turbine have been provided, embodiments could also be applied to double flow steam turbines. The presently disclosed embodiments are therefore considered in all respects to be illustrative and not restricted.

Although the disclosure has been described in connection with exemplary embodiments thereof, it will be appreciated by those skilled in the art that additions, deletions, modifications, and substitutions not specifically described may be made without departing from the spirit and scope of the invention as defined in the appended claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| REFERENCE NUMBERS | |
|---|---|
| 1 | Radially fed axial steam turbine |
| 5 | Rotor |
| 6 | Circumferential surface |
| 8 | Piston Region |
| 10 | Casing |
| 25 | Blade and vane rows |
| 30 | Hot inlet duct |
| 31 | Inlet end |
| 32 | Outlet end |
| 35 | Hot steam |
| 36 | Hot inlet spiral |
| 37 | Hot inlet pipe |
| 40 | Cold inlet duct |
| 41 | Inlet end |
| 42 | Outlet end |
| 45 | Cold steam |
| 46 | Cold inlet spiral |
| 47 | Cold inlet pipe |
| 48 | Radial section |
| 49 | Axial section |
| AD | Axial direction |
| RD | Radial direction |

What is claimed is:

1. A high temperature radially fed axial steam turbine comprising:

a rotatable rotor with a rotational axis and a circumferential surface;

a casing enclosing the rotor so as to form an annular space between the rotor and the casing;

axially distributed blade and vane rows mounted in the annular space on the rotor;

a hot inlet duct for hot steam, that circumferentially extends around the rotor axis and including a radial inlet end circumscribing the rotor, and an axial outlet end circumscribing the rotor and axially joined to the annular space immediately upstream of the blade and vane rows;

a cold inlet spiral for receiving a cold steam, circumferentially extending around the rotor axis that is configured to circumferentially distribute the cold steam; and a cold inlet duct for a cold steam, connected at an inlet end to a downstream end of the cold inlet spiral and axially displaced from the hot inlet duct such that the hot inlet duct is between the cold inlet duct and blade and vane rows, the cold inlet duct having an outlet end, in the hot inlet duct, that circumscribes the rotor and is configured to provide a boundary layer of cold steam over the circumferential surface between the outlet end of the cold inlet duct and the blade and vane rows, wherein the rotor circumferential surface between the cold inlet duct outlet end and the blade and vane rows is configured to promote and maintain the boundary layer.

2. The steam turbine of claim 1 wherein the inlet end of the cold inlet duct is a radial inlet end.

3. The steam turbine of claim 1 wherein the cold inlet duct comprises:

a radial section;

an axial section; and an axial outlet end.

4. The steam turbine of claim 1, wherein the outlet end of the cold inlet duct is parallel to the hot inlet duct.

5. The steam turbine of claim 1, wherein the outlet end is configured to provide a boundary layer of cold steam between the outlet end of the cold inlet duct and the blade and vane rows by having straight side walls that are essentially parallel and free of projections that extend into the cold inlet duct.

6. The steam turbine of claim 1, wherein the rotor circumferential surface is configured to promote formation of the boundary layer via smooth surfaces that are free of edges.

7. The steam turbine of claim 1, comprising:

a hot inlet spiral that circumferentially extends around the rotor axis and has a downstream end connected to the inlet end of the hot inlet duct.

8. The steam turbine of claim 7, comprising:

a hot inlet pipe connected to the hot inlet spiral for enabling flow of hot steam sequentially through the hot inlet pipe, the hot inlet spiral and hot inlet duct to the blade and vane rows; and a cold inlet pipe connected to the cold inlet spiral for enabling flow of cold steam sequentially through the cold inlet pipe, the cold inlet spiral and cold inlet duct to the hot inlet duct.

9. The steam turbine of claim 8, wherein the cold inlet pipe is parallel to the hot inlet pipe.

10. The steam turbine of claim 8, wherein the cold inlet pipe is angled, in a radial direction, at least 90 degrees from the hot inlet pipe.

11. The steam turbine of claim 8, comprising:

a plurality of hot inlet pipes and a plurality of cold inlet pipes.

12. The steam turbine of claim 2, wherein the cold inlet duct comprises:

a radial section;

an axial section; and an axial outlet end.

13. The steam turbine of claim 12, wherein the outlet end of the cold inlet duct is parallel to the hot inlet duct.

14. The steam turbine of claim 13, wherein the outlet end is configured to provide a boundary layer of cold steam between the outlet end of the cold inlet duct and the blade and vane rows by having straight side walls that are essentially parallel and free of projections that extend into the cold inlet duct.

15. The steam turbine of claim 14, wherein the rotor circumferential surface is configured to promote formation of the boundary layer via smooth surfaces that are free of edges.

16. The steam turbine of claim 15, comprising:

a hot inlet spiral that circumferentially extends around the rotor axis and has a downstream end connected to the inlet end of the hot inlet duct.

17. The steam turbine of claim 16, comprising:

a hot inlet pipe connected to the hot inlet spiral for enabling flow of hot steam sequentially through the hot inlet pipe, the hot inlet spiral and hot inlet duct to the blade and vane rows; and a cold inlet pipe connected to the cold inlet spiral for enabling flow of cold steam sequentially through the cold inlet pipe, the cold inlet spiral and cold inlet duct to the hot inlet duct.

18. A method for operating a high temperature radially fed axial steam turbine having a rotatable rotor with a rotational axis and a circumferential surface; a casing enclosing the rotor so as to form an annular space between the rotor and the casing; axially distributed blade and vane rows mounted in the annular space on the rotor; a hot inlet duct for hot steam, that circumferentially extends around the rotor axis and has: a radial inlet end circumscribing the rotor; and an axial outlet end circumscribing the rotor and axially joined to the annular space immediately upstream of the blade and vane rows, the method comprising:

receiving a cold steam via a cold inlet spiral circumferentially extending around the rotor axis to circumferentially distribute the cold steam, a cold inlet duct for the cold steam being connected at an inlet end to a downstream end of the cold inlet spiral and being axially displaced from the hot inlet duct such that the hot inlet duct is between the cold inlet duct and blade and vane rows, the cold inlet duct having an outlet end, in the hot inlet duct, that circumscribes the rotor and is configured to provide a boundary layer of cold steam over the circumferential surface between the outlet end of the cold inlet duct and the blade and vane rows, wherein the rotor circumferential surface between the cold inlet duct outlet end and the blade and vane rows is configured to promote and maintain the boundary layer; and simultaneously injecting the cold steam through the hot inlet duct and the hot steam through the hot inlet duct, wherein a temperature of the cold steam is less than a temperature of the hot steam.

19. The method of claim 18, wherein the temperature of the hot steam is greater than 650° C., and the temperature of the cold steam is less than 650° C.

20. The method of claim 18, wherein the temperature of the hot steam is greater than 700° C., and the temperature of cold steam is less than 600° C.

* * * * *